United States Patent [19]

Van Pelt

[11] Patent Number: 4,538,801

[45] Date of Patent: Sep. 3, 1985

[54] PAPER SHEET HANDLING MECHANISM

[75] Inventor: Christopher K. Van Pelt, Venice, Fla.

[73] Assignee: Therm-O-Type Corporation, Nokomis, Fla.

[21] Appl. No.: 386,602

[22] Filed: Jun. 9, 1982

[51] Int. Cl.[3] ..... B65H 5/02; B65H 9/16

[52] U.S. Cl. ..... 271/251; 83/107; 198/725

[58] Field of Search ..... 271/251, 226, 234, 239, 271/7, 109, 248, 253, 275; 198/458, 725, 735; 83/89, 107

[56] References Cited

U.S. PATENT DOCUMENTS

| | | | |
|---|---|---|---|
| 2,006,294 | 6/1935 | Beardsley | 198/725 X |
| 2,100,585 | 11/1937 | Beardsley | 198/725 X |
| 2,155,895 | 4/1939 | Gibson, Jr. . | |
| 2,219,892 | 10/1940 | Gibson, Jr. . | |
| 3,415,509 | 12/1968 | Tyburski | 271/248 |
| 3,860,232 | 1/1975 | Martin | 271/299 X |

FOREIGN PATENT DOCUMENTS 761607 11/1956 United Kingdom .

*Primary Examiner*—Bruce H. Stoner, Jr.
*Assistant Examiner*—Lawrence J. Goffney, Jr.
*Attorney, Agent, or Firm*—Burns, Doane, Swecker & Mathis

[57] ABSTRACT

A slitter feeds paper sheets one-at-a-time from a stack onto an alignment table and against a guide surface. A quick and accurate adjustment for the guide surface enables the orientation of the guide surface and thus of the sheets to be adjusted. The sheets are fed to a cutter and are cut into segments. The cutters include radially overlapping cutting edges which are freely separable, against a spring-bias, to accommodate the simultaneous passage of more than one sheet. The cut segments are discharged onto conveyor assemblies and fanned-out in divergent directions for collection. The conveyor assemblies support the segments along laterally spaced lines and frictionally engage the segments with a drive belt intermediate the lines of support. A quick-release clutch enables the drive to the sheet feeding mechanism to be interrupted.

8 Claims, 14 Drawing Figures

284
282
286
96A
48
50
72
74
84
76
90
50
96B
200
92A
94B
234
202
214
66
92B
53
72
60
56
54
206
62
124
210
58
70
78
44
126
52
66
214
120
122
64
210
28
230
228
202
206
200
74
204
208
204
212
130
230
208
302
204
212
208
20
214
234
200
202
42
302
332
209
310
316

PAPER SHEET HANDLING MECHANISM

BACKGROUND AND OBJECTS OF THE INVENTION

The present invention relates to paper handling, such as the feeding, aligning, slitting, and/or stacking of sheets of paper or the like and, in particular, to paper slitters in which such functions are performed.

Paper slitters are employed in various applications for cutting sheets of paper into smaller segments. For example, items such as business cards are typically produced by forming a plurality of indicia patterns on a sheet of relatively stiff paper (as by printing, thermography, etc.), and then slitting the sheet into segments, each segment containing one or more of the indicia patterns. Further slitting may thereafter be performed to cut the segments down to the individual indicia patterns.

Slitting has been heretofore performed by automated machinery which (i) receives a stack of sheets, (ii) feeds the sheets one-at-a-time to an aligning section where the sheets are properly oriented, (iii) cuts the aligned sheets into segments, (iv) fans-out the slit segments, and (v) overlaps or "shingles" the cut segments for convenient manual gathering or stacking.

A slitter machine of this type has heretofore been manufactured and sold by the Gibson Machine Manufacturing Co. of Brooklyn, N.Y. (see also U.S. Pat. Nos. 2,155,895 and 2,219,892 issued to G. A. Gibson, Jr. on Apr. 25, 1939 and Oct. 29, 1940, respectively, which disclose sheet-feeding mechanisms suitable for use on such a slitter).

The aligning of the sheets prior to being slit can be performed by abutting the sheets against an adjustable guide surface as the sheets are being advanced by a driven belt. However, performing an adjustment of the guide surface to change the sheet orientation has heretofore been slow and tedious, resulting in overly long shut-down periods.

The cutting of the sheets has heretofore been performed by means of cooperating upper and lower cutter rolls which cut the sheets into segments, and trim the side edges of the sheets. Each roll may include a circular cutting edge arranged such that cooperating upper and lower cutting edges overlap radially to cut in a scissor-like manner (e.g., see the rotary cutters of British Pat. No. 761,607 published Nov. 14, 1956). One of the opposing rolls may be provided with resilient O-rings which bear against the other roll. The rolls are fixedly mounted on parallel shafts and are relatively immovable in the axial directions during a cutting operation. It is intended that the rolls cut through the sheets in one-at-a-time fashion. On occasion, however, it may occur inadvertently that a plurality of sheets are fed simultaneously to the cutter. In such a case, jamming of the machine may occur, due to the inability of the rolls to accommodate a plurality of sheets.

Conveying of the cut segments in a divergent or fanned-out pattern is desirable in order to prevent the segments from becomming laterally overlapped and thereby interfering with proper collection of the segments in shingled rows or stacks at a downstream collection station. Heretofore, fanning-out has been achieved by means of diverging conveyor belts upon which the segments ride while being held down by a row of hold-down rolls, similar to the manner of conveyance at the aligning station. This type of conveying assembly involves numerous parts which add significantly to the expense of constructing and maintaining the machine. It is possible to eliminate the need for fanning-out of the segments by cutting-out scrap strips between adjacent segments during the splitting step. This creates a space between adjoining segments which prevents the occurrence of lateral overlap. However, such an operation results in an excessive waste of paper.

During operation of a slitter, it may be desirable to interrupt the in-feed of sheets while continuing the other functions. Clutches heretofore employed for achieving this have been complicated and unsatisfactory, and can be actuated only from one location.

It is, therefore, an object of the present invention to provide a novel paper slitting machine.

A further object is to provide such a machine which is relatively uncomplicated and well-suited to the high-speed feeding and cutting of paper sheets.

A further object is to provide an indexing mechanism for accurately aligning the sheets in a fast and simple manner.

Yet another object is to enable roller-type cutters to accommodate the simultaneous passage of more than one sheet.

Another object is to provide an inexpensive segment conveying mechanism which is relatively uncomplicated and suited to high-speed operations.

A further object is to provide a simplified clutching mechanism which enables the in-feeding of sheets to be interrupted from different locations at the machine.

SUMMARY OF THE INVENTION

These objects are achieved in accordance with the present invention which involves a conveying mechanism wherein a plurality of segments are conveyed upon a plurality of guides. Each guide extends in a fore-aft direction and is arranged to support a respective segment along laterally spaced lines of support. A plurality of movable driving members are disposed above respective ones of the guide members and are arranged to bear against the segments intermediate the lines of support thereof in order to deflect the segments downwardly and effect a frictional engagement therewith in the fore-aft direction.

Preferably, the driving members comprise endless bands, the lower flights of which directly engage the sheets.

Preferably, the lines of support are offset vertically so that the segments are conveyed while inclined relative to horizontal. Each guide member includes a retaining leg for restraining the adjacent lower edge of each sheet against lateral displacement.

Preferably, the guides are disposed downstream of a cutting mechanism which cuts the segments from sheets. The cutting mechanism is disposed downstream of an aligning section wherein the sheets are positioned in a selected orientation. The aligning station comprises a locator surface extending in a fore-aft direction and against which an edge of each sheet is adapted to engage to locate the sheets. A conveyor is arranged to move the sheets simultaneously toward the cutting mechanism and the locator surface. An indexing mechanism is provided for indexing the locator surface. The indexing mechanism includes a carrier, and a first threaded member connected to the carrier for moving the latter in response to rotation of the first threaded member. A pair of independently movable actuator members are movably disposed in the carrier and are spaced apart in the fore-aft direction. Each actuator member is operably connected to the locator surface to displace the latter in at least one direction laterally of the fore-aft direction. A pair of independently rotatable second threaded members are connected to the actuator members for moving the latter relative to the carrier. The first threaded member is operable to move the carrier and both actuating members simultaneously. The second threaded members are operable to effect movement of the actuating members relative to the carrier and relative to each other.

The cutting mechanism preferably comprises a plurality of pairs of cutter rolls. Each cutter roll includes a cutting edge, with opposing cutting edges arranged in radially overlapping relationship. One cutter roll of each pair is movable axially relative to the other to enable the cutting edges to separate if more than one sheet passes therethrough. A spring yieldably opposes such separation.

Preferably, there is provided a feeding mechanism for feeding the sheets one-at-a-time from a stack. The feeding mechanism includes a rotary feed roll mounted on a drive shaft. The drive coupling to that shaft can be interrupted by means of a clutch without affecting the drive of other driven shafts of the machine. The clutch can be actuated near the front and rear ends of the machine and includes a de-clutching shaft which slides coaxially within the shaft to which the feed roll is mounted.

THE DRAWINGS

The objects and advantages of the invention will become apparent from the following detailed description of a preferred embodiment thereof, in connection with the accompanying drawings in which like numerals designate like elements, and in which:

FIG. 7 is a longitudinal sectional view taken along line 7—7 of FIG. 2, depicting the in-feed section;

DETAILED DESCRIPTION OF A PREFERRED EMBODIMENT OF THE INVENTION

Figure 1:
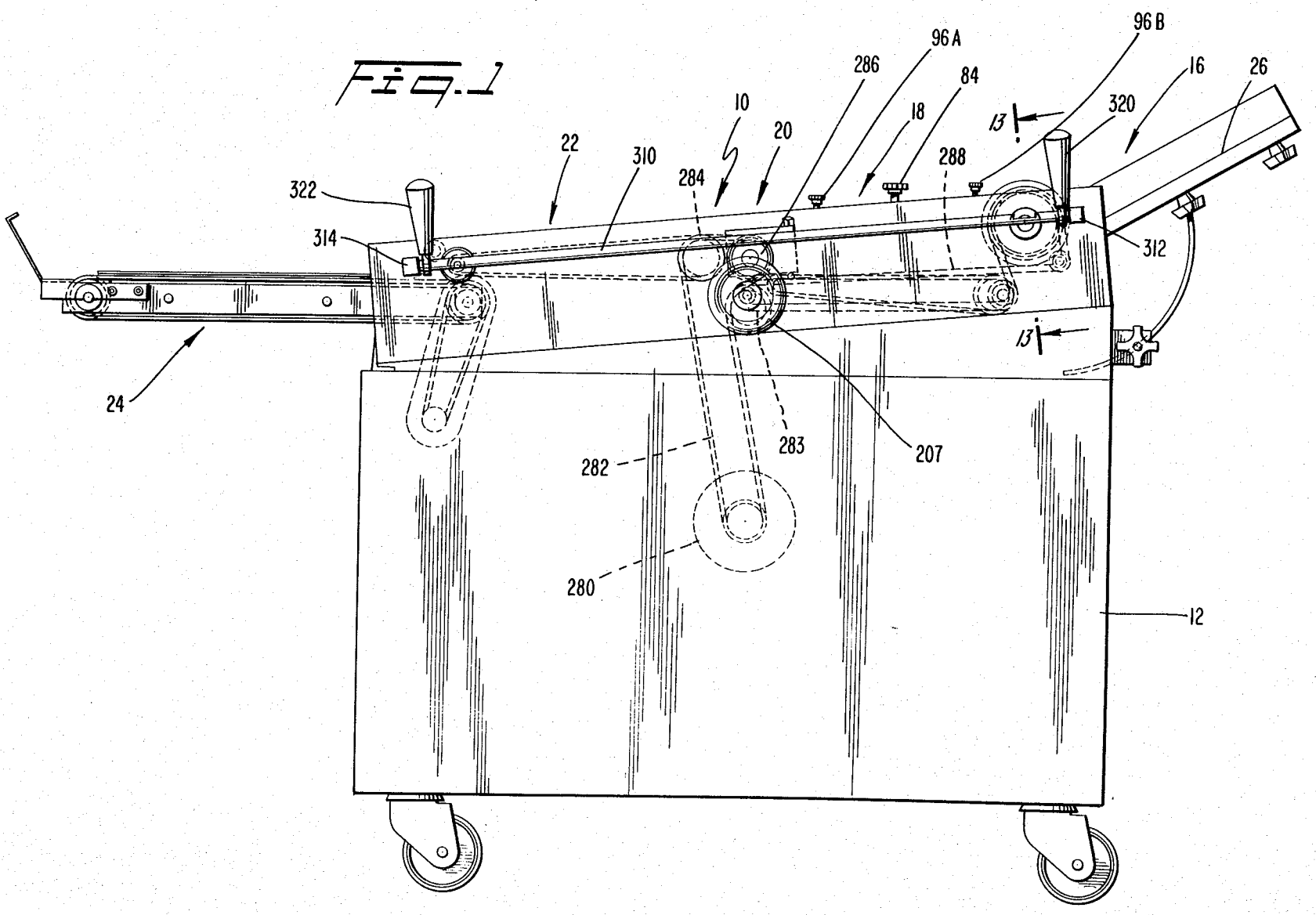
FIG. 1 is a side elevational view of a paper slitting machine according to the present invention.

A paper slitter 10 in accordance with the present invention comprises a wheeled frame 12 on which is mounted a paper handling and cutting mechanism. Such mechanism includes a sheet in-feed section 16, and a sheet alignment section 18 disposed downstream of the in-feed section 16 to align the sheets received from the latter. A cutting section 20 is located at the downstream end of the alignment section 18 to slit the sheets into individual segments. Downstream of the cutting section 20 is disposed a fan-out section 22 which diverges the cut segments. The diverged segments are then delivered to a collecting section 24 where they are arranged in overlapped or shingled relationship for collection or stacking.

In-Feed Section

The in-feed section 16 comprises an inclined chute 26 upon which is placed a stack of sheets S to be slit, as depicted in FIG. 7. At the lower end of the chute is disposed a sheet feeding mechanism comprising at least one feed roll 28 and an opposing pressure roll 30. The pressure and feed rolls are spaced apart by a distance equal to the thickness of a sheet S. The feed roll 28 is mounted on a drive shaft 36 which is driven about an axis extending perpendicular to the fore-aft direction of travel of the sheets.

As the feed roll 28 rotates, the sheets S are fed between the rolls 28, 30 in one-at-a-time fashion, since only a single sheet S can pass between those rolls. The fed sheets are delivered to the upstream end of the alignment section 18.

Alignment Section

The alignment section 18 comprises a table 40 (FIGS. 5, 10, 11) along which the sheets S are fed. The table 40 comprises a stationary base plate 42 and a movable plate 44 slidably disposed on the base plate 42. Mounted on the movable plate 44 is a positioning block 46. The block 46 comprises a vertical surface 48, a deflecting portion 50, and a follower surface 51. The deflecting portion includes a curved front section 53 (FIG. 6) for guiding sheets onto the plates 42, 44.

An endless conveyor belt 52 (FIG. 5) is positioned such that its upper flight 54 travels across the upper surface of the movable plate 44. A pair of recesses 56, 58 are provided in opposite edges of the movable plate to accommodate a drive roll 60 and an idler roll 62, respectively, around which the belt 52 is wrapped.

The drive roll 60 is fixed to a drive shaft 64 which is driven in a manner to be later described. The idler roll 62 is mounted in freely rotatable fashion to a pair of fixed brackets 66.

The horizontal axes of rotation of the drive roll 60 and support roll 62 are mutually parallel and oriented at an acute angle to the fore-aft direction of the vertical surface 48. That is, the direction of travel of the upper flight 54 of the belt 52 approaches the vertical surface 48 of the movable plate 44.

Figure 3:
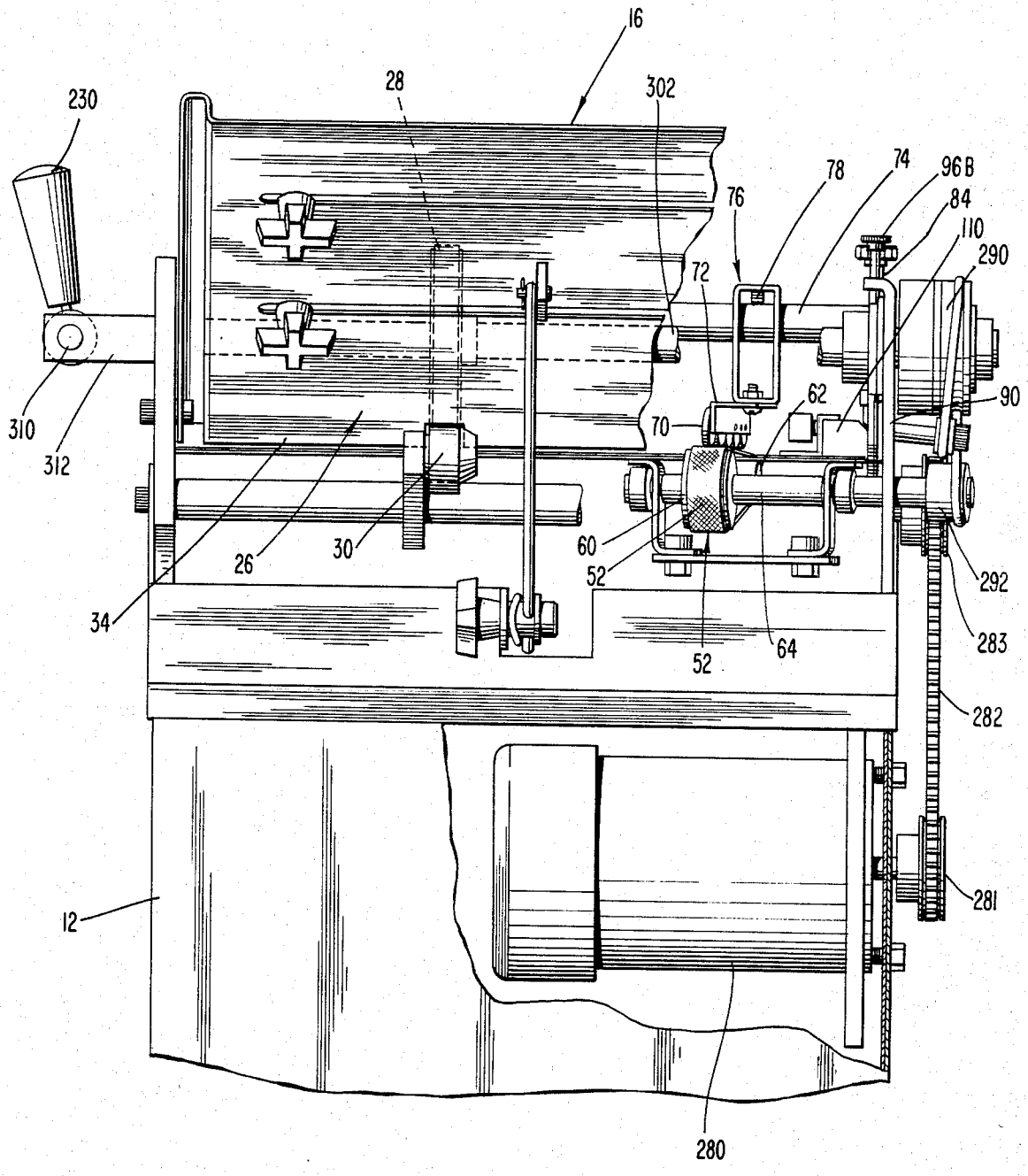
FIG. 3 is an end view of the paper slitting machine taken at the in-feed end of the machine (i.e., from the right as viewed in FIG. 2)

Disposed above the belt 52 are a series of hold-down rolls 70 having horizontal axes of rotation oriented parallel to the axes of the drive and support rolls 60, 62. An arm 72 carries the rolls 70, the arm 72 being adjustably mounted to an overpassing bar 74 by means of a slidable bracket 76 (FIG. 3). An adjustable stop screw 78 bears against the bar 74 to retain the arm 72 in the desired location. The hold-down rolls 70 function to maintain the sheets S in frictional engagement with the upper flight 54 of the belt 52.

It will thus be appreciated that as sheets S are delivered one-at-a-time to the alignment section 18 by means of the feed roll 28 (FIG. 7), those sheets are frictionally contacted and advanced by the belt 52. Since the direction of travel of the upper flight of the belt approaches the vertical surface 48, the sheets S will be displaced toward the vertical surface 48 while being simultaneously conveyed in a fore-aft direction toward the cutting section 20. This assures that the outermost side edge of each sheet S will contact the vertical surface. Accordingly, the vertical surface 48 serves as a locator surface for the sheets S. By moving the locator surface 48, the orientation of the sheets S being fed to the cutting section 20 can be altered.

Figure 6:
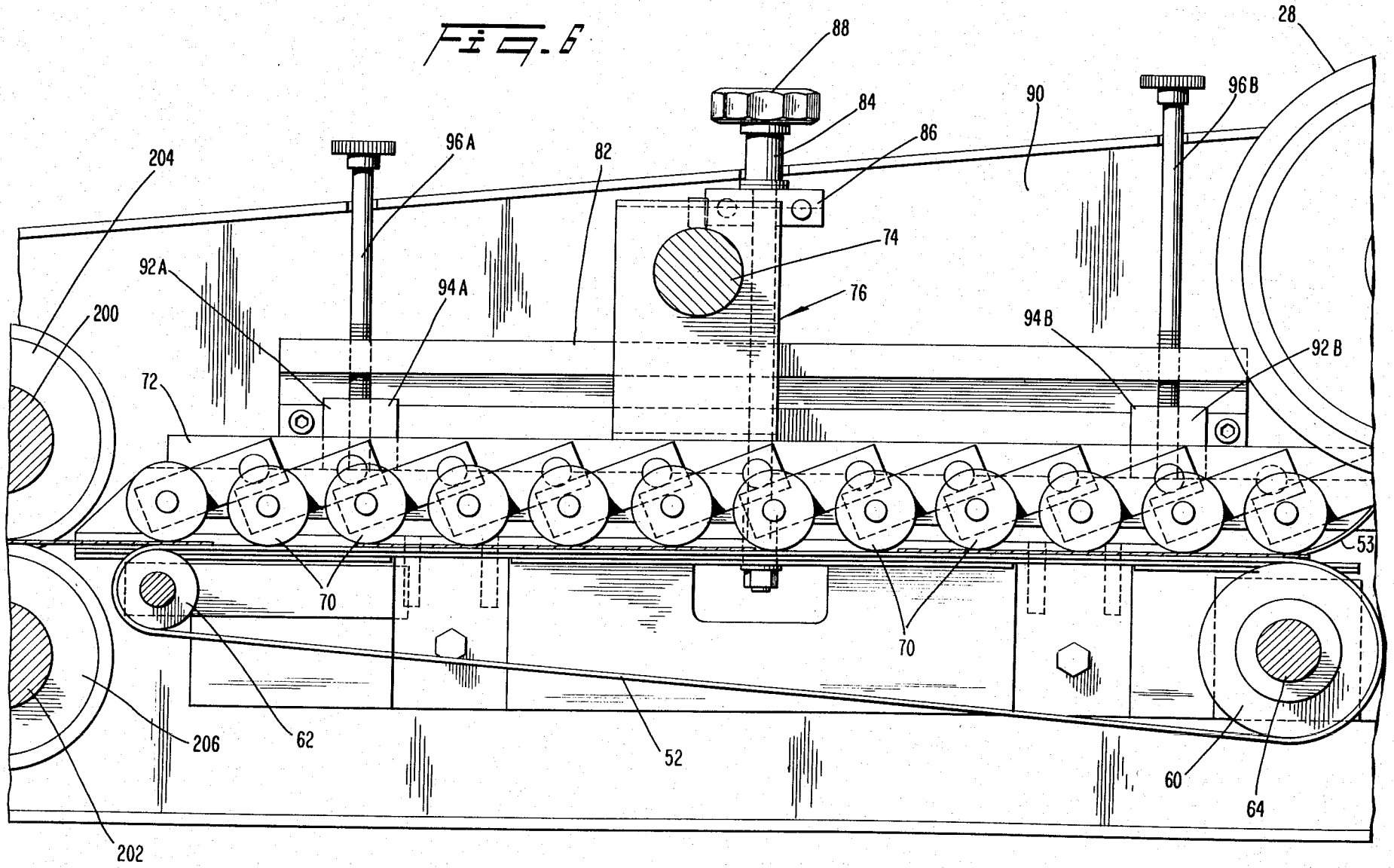
FIG. 6 is a longitudinal sectional view taken along line 6—6 of FIG. 2, depicting the in-feed section.
Figure 1:
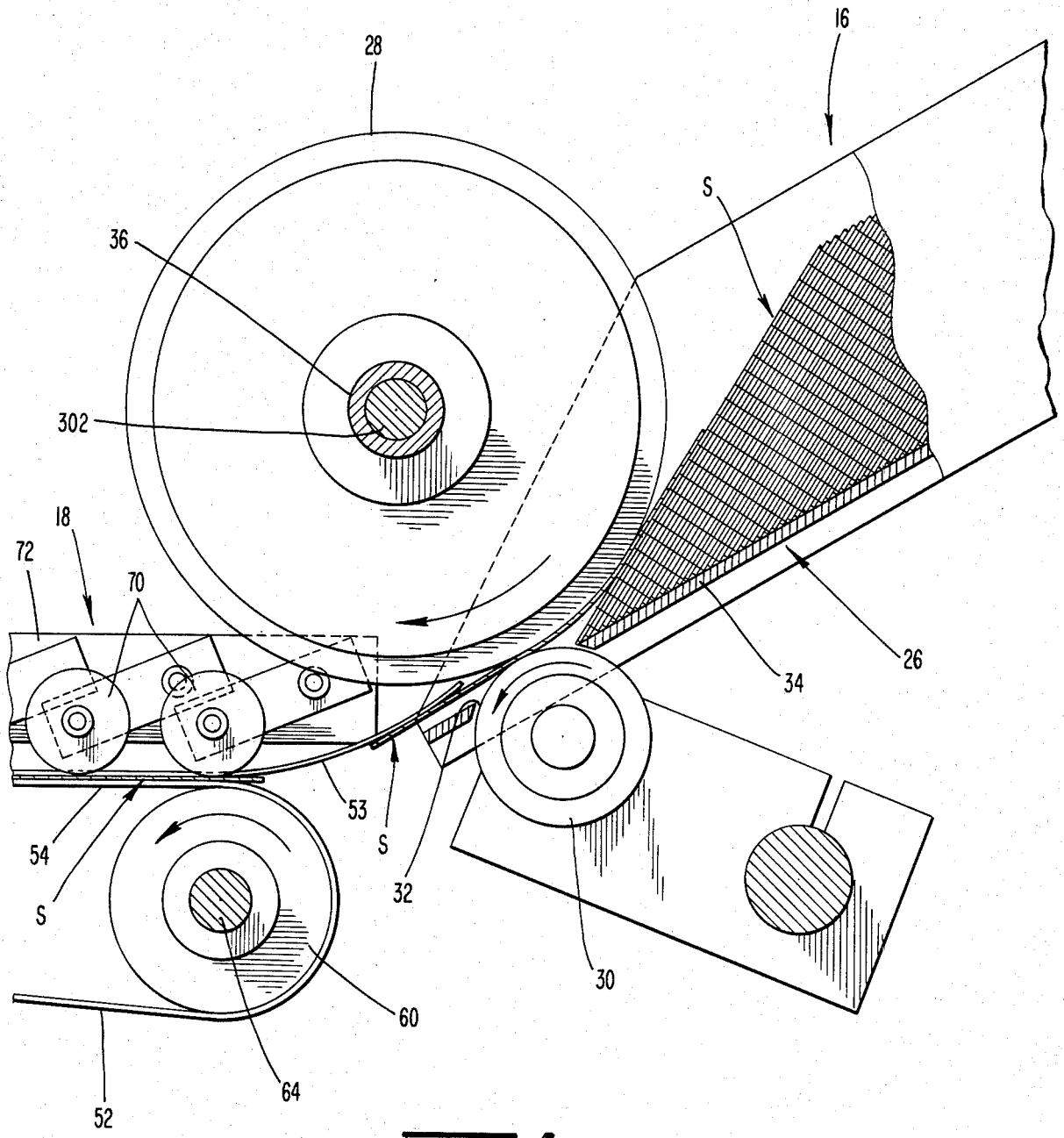
Figure 10:
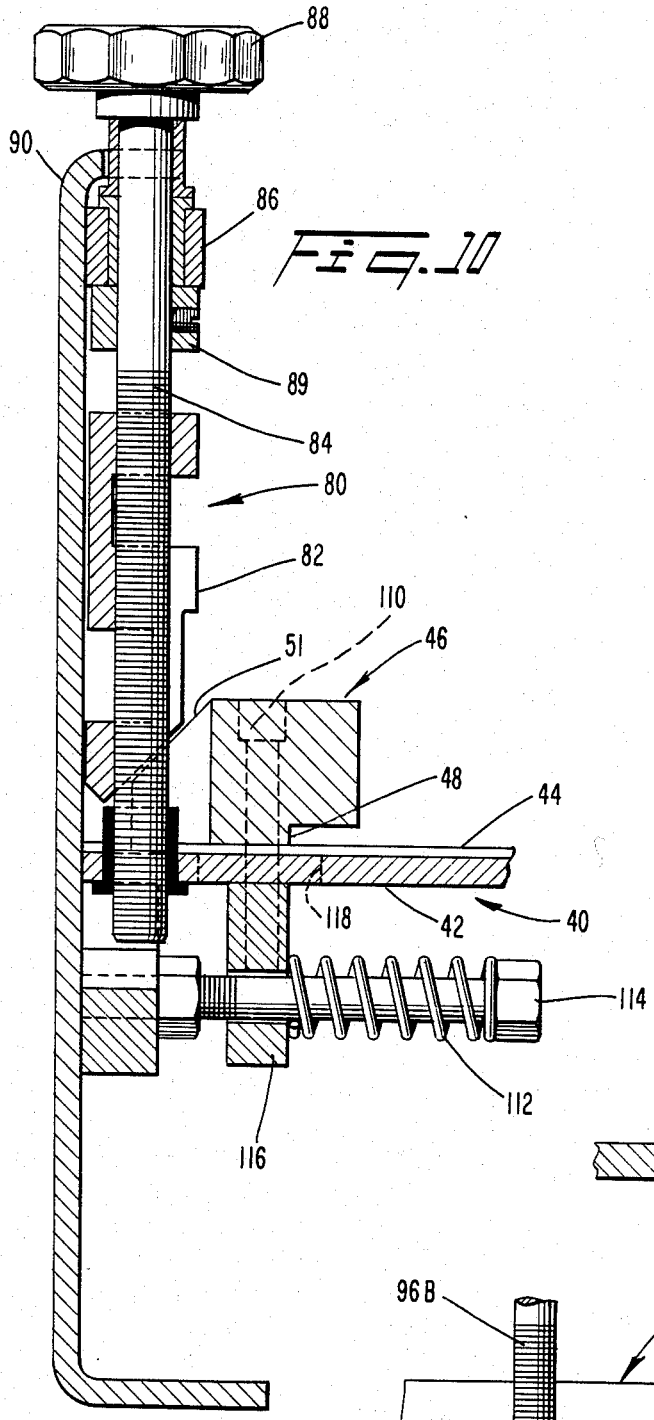
FIG. 10 is a cross-sectional view taken along line 10—10 of FIG. 2, depicting an indexing mechanism for an aligning section of the machine.
Figure 11:
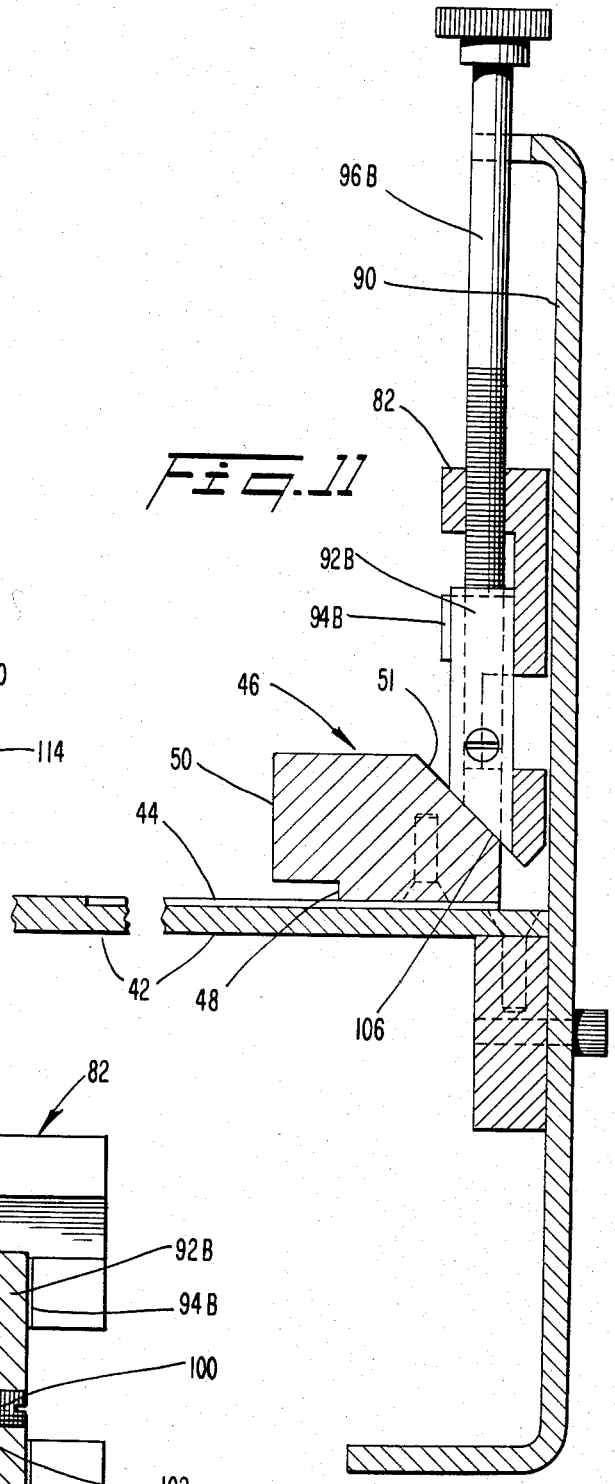
FIG. 11 is a cross-sectional view taken along line 11—11 of FIG. 2, depicting another portion of the indexing mechanism.

Such an adjustment of the locator surface 48 is performed by means of an adjustment mechanism 80 (FIGS. 6, 10, 11). The adjustment mechanism comprises a carrier 82 which is disposed laterally outwardly of and above the positioning block 46. An upright, externally threaded main bolt 84 (FIGS. 6, 10) is threadedly connected within an internally threaded hole of the carrier 82 to suspend the latter. In this regard, the main bolt 84 is rotatably mounted within a journal 86 and includes a manual actuating handle 88. The journal 86 is fixed to a side wall 90 of the frame 12. A stop 89 is affixed to the bolt 84 and is disposed below the journal 86. Thus, the bolt 84 cannot move vertically; it can only rotate. By rotating the main bolt 84, the carrier 82 is moved upwardly or downwardly.

Figure 12:
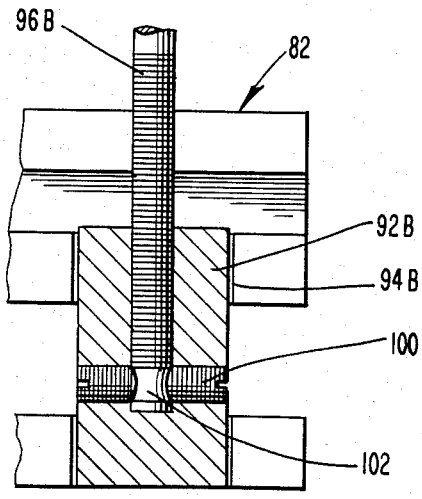
FIG. 12 is a longitudinal sectional view taken along a portion of the indexing mechanism.

Carried by the carrier 82 are a pair of adjustable actuators in the form of wedge slides 92A,B (one wedge slide 92B depicted in FIG. 11) disposed on opposite sides of the main bolt 84. The wedge slides 92A,B are slidably mounted within vertical channels 94A,B in the carrier 82 which confine the wedge slides 92A,B to vertical movement. Mounted to the wedge slides 92A,B are a pair of secondary bolts 96A,B. Lower ends of the secondary bolts 96A,B are retained in the wedge slides by stop screws 100 which enter annular grooves 102 (FIG. 12) in the secondary bolts. The stop screws 100 prevent vertical movement of the secondary bolts 96A,B relative to the wedge slides 92A,B while permitting relative rotation therebetween.

The secondary bolts 96A,B are threadedly received within internally threaded holes 102 of the carrier 82 so that rotation of either or both of the secondary screws 96A,B produces vertical movement of the associated wedge slides 92A,B relative to the carrier 82. On the other hand, rotation of the main bolt 84 produces vertical movement of the carrier 82 and thus, vertical movement of the wedge slides 92A,B which are, in effect, movable along with the carrier 82 by virtue of the threaded coupling between the carrier and the secondary bolts 96A,B.

The wedge slides 92A,B each includes a wedge surface 106 which bears against the follower surface 51 of the positioning block 46. Thus, when either (or both) of the wedge slides 92A,B is lowered relative to the positioning block 46, that wedge slide displaces the block in a direction (to the left in FIG. 11) causing the locator surface 48 to be shifted laterally inwardly. When either or both of the wedge slides 92A,B are raised relative to the block 46, the locator surface 48 is shifted laterally outwardly (to the right in FIG. 11). This latter movement is produced by coil compression springs 112 which are mounted on bolts 114 and arranged to contact downwardly depending lugs 116 which are secured to the positioning block 50 by bolts 110. It will be appreciated that the positioning block and the movable plate 44 move together as a unit. The lugs 116 pass through slots 118 in the stationary plate 42 which permit a limited range of travel of the lugs. The movable plate 44 is tightly held between the block 46 and the lugs 116 so as to prevent the entry of paper therebetween.

Movement of the movable plate 44 can be visually detected and measured by means of scales 120, 122 (FIG. 5) inscribed on the stationary plate 42. Edges 124, 126 of the movable plate 44 serve as indicators whereby it is possible to accurately adjust the positioning plate.

Thus, it is possible to precisely adjust the lateral positioning of the sheets S as they are being advanced, by moving the movable plate 44 and its locator surface 48. Equal movement of both ends of the block 46 is achieved by rotating the main bolt 84, whereas movement of one end of the block 46 relative to the other end is produced by the secondary bolts 96A,B. It will be appreciated that when the wedge slides 92A,B are raised and lowered relative to the carrier 82, the channels 94A,B in the carrier serve to guide the wedge slides for vertical travel. When the carrier 82 is raised and lowered, the secondary bolts 96A,B serve to guide the carrier 82 as they slide within their fixed journals 98A,B.

It may be desirable to adapt the slitter for simultaneously performing different-type cuts. This is desirable, for instance when sheets of a width less than the width of the table 40 are to be cut twice, i.e., initially the sheets are cut into segments of a given size, and thereafter each segment is to be cut into sub-segments. In such a case, the sheets are initially placed on one side of the in-feed station 16 (i.e., the top side as viewed in FIG. 2) and conveyed to the cutting station 20 by means of the afore-mentioned conveyor belt 52. The cut segments would thereafter be placed on the opposite side of the in-feed section 16 (i.e., the lower side as viewed in FIG. 2) and delivered by another feed roll to the alignment section 18. The segments would then be conveyed to the cutting section 20 by means of a conveyor belt (not shown) identical to the afore-described belt 52, but located at the opposite side of the table 40. Such an identical belt would also be provided with hold-down rollers, a movable plate, and an adjusting mechanism identical to that already described. By virtue of such an arrangement, the two types of cuts could be performed sequentially or simultaneously.

Cutting Section

Figure 5:
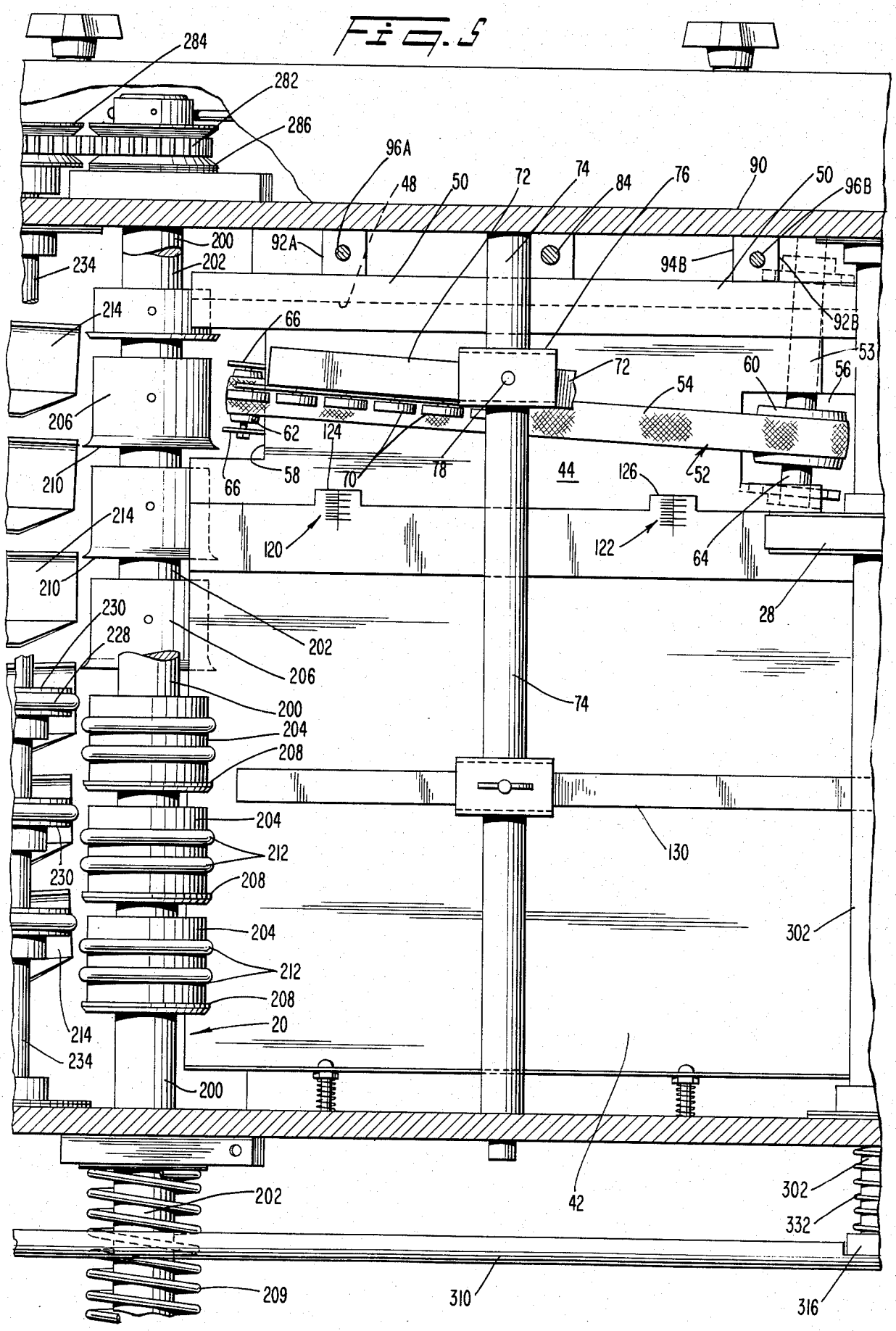
FIG. 5 is a plan view of an aligning section of the machine in which sheets received from the in-feed station are properly located and advanced to the cutting mechanism.
Figures 13, 14:
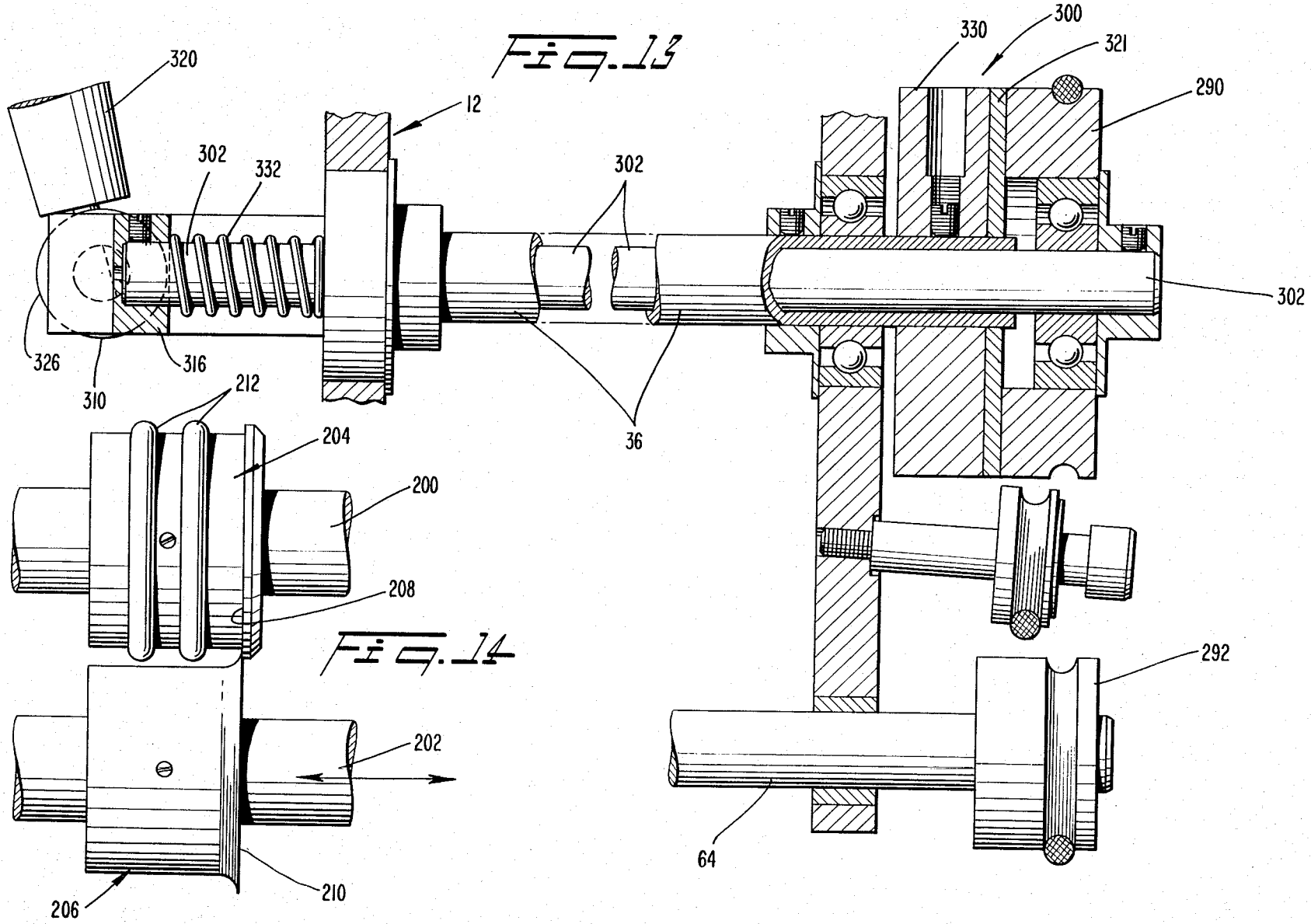
FIG. 13 depicts a drive mechanism for the feed roll, and a clutch mechanism for interrupting the drive to the feed roll.
FIG. 14 is a front view of a portion of the cutter mechanism, depicting one set of cutter rolls.

Sheets S which are conveyed by the advancement section travel through the cutting section 20 (FIGS. 5 and 14). The latter comprises upper and lower drive shafts 200, 202, both of which extend transversely of the fore-aft direction of travel of the sheets and are connected to a drive mechanism for common rotation. These shafts 200, 202, respectively, carry cooperating cutting rolls 204, 206, which are arranged above and below one another. The cutting rolls include sharpened circular edges 208, 210 which are generally superimposed in cooperative fashion for slitting the sheets. That is, the edges 208, 210 overlap one another in the radial direction to effect a scissors-like severing of sheets passed therebetween. The upper rolls 204 each carry resilient annular rings 212 which bear against the lower rolls 206 and serve as feeders for sheets being cut.

The lower drive shaft 202 carries a handle 207 (FIGS. 1 and 5) which is accessible externally of the housing 12 to enable an operator to push inwardly against the lower drive shaft and thereby disengage the cutting edges 208, 210 (i.e., the lower cutter rolls 206 are displaced axially relative to the upper cutter rolls 204). A coil compression spring 209 is disposed between the handle 207 and the frame 12 to bias the lower shaft 202 outwardly, i.e., to yieldably bias the cutting edges 208, 210 into cutting engagement. In the event that more than one sheet enters the nip between the cutter rolls, the lower cutting edges 210 can shift away from the upper cutting edges 208 against the bias of the spring 209, thereby preventing the machine from jamming. Return movement of the lower cutting edges 210 is dampened by contact between the resilient rings 212 and the lower cutter rolls 206.

Fan-Out Section

Figure 4:
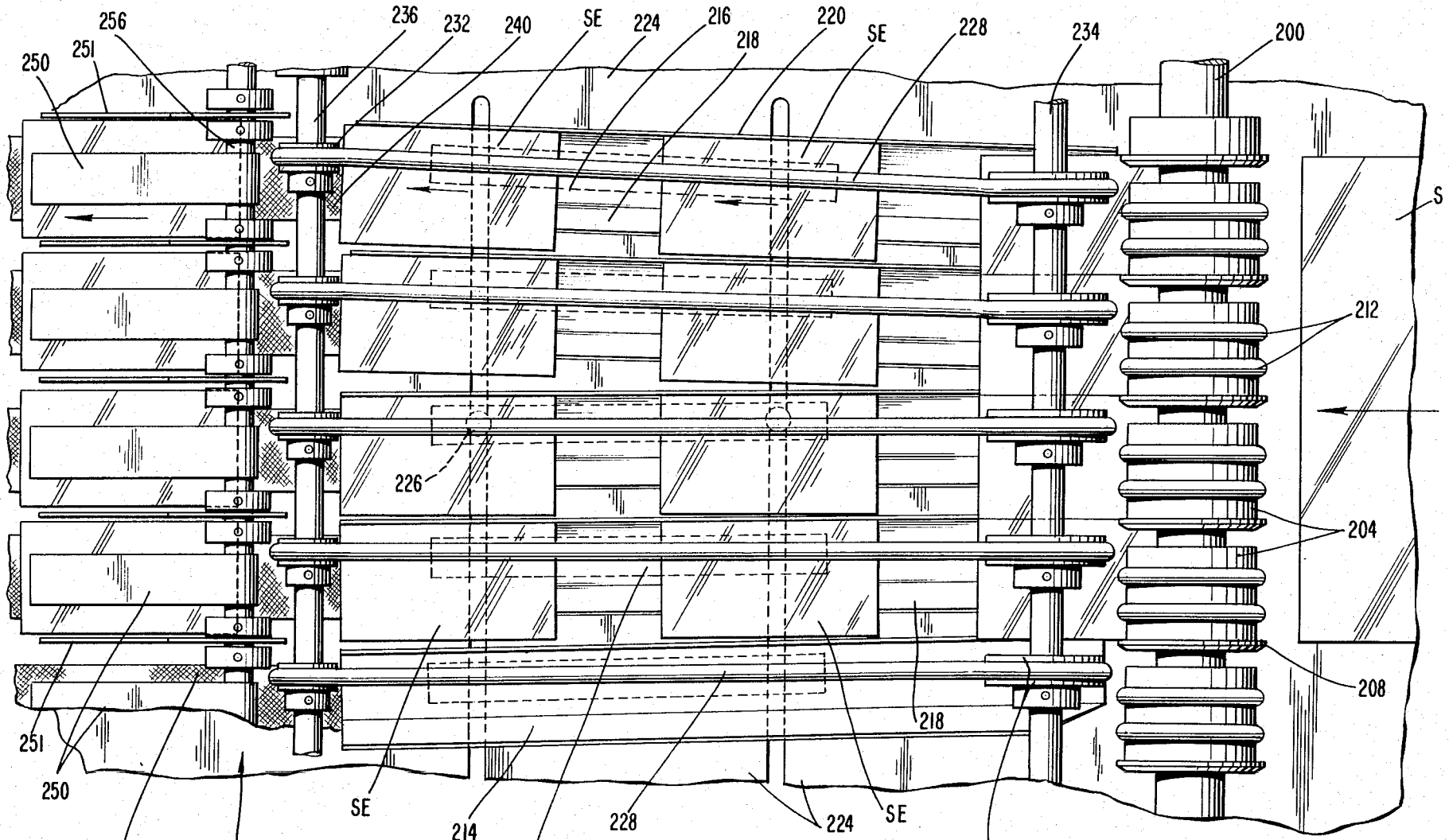
FIG. 4 is a plan view of a fan-out section of the machine wherein cut segment are advanced while being diverged relative to one another.
Figure 9:
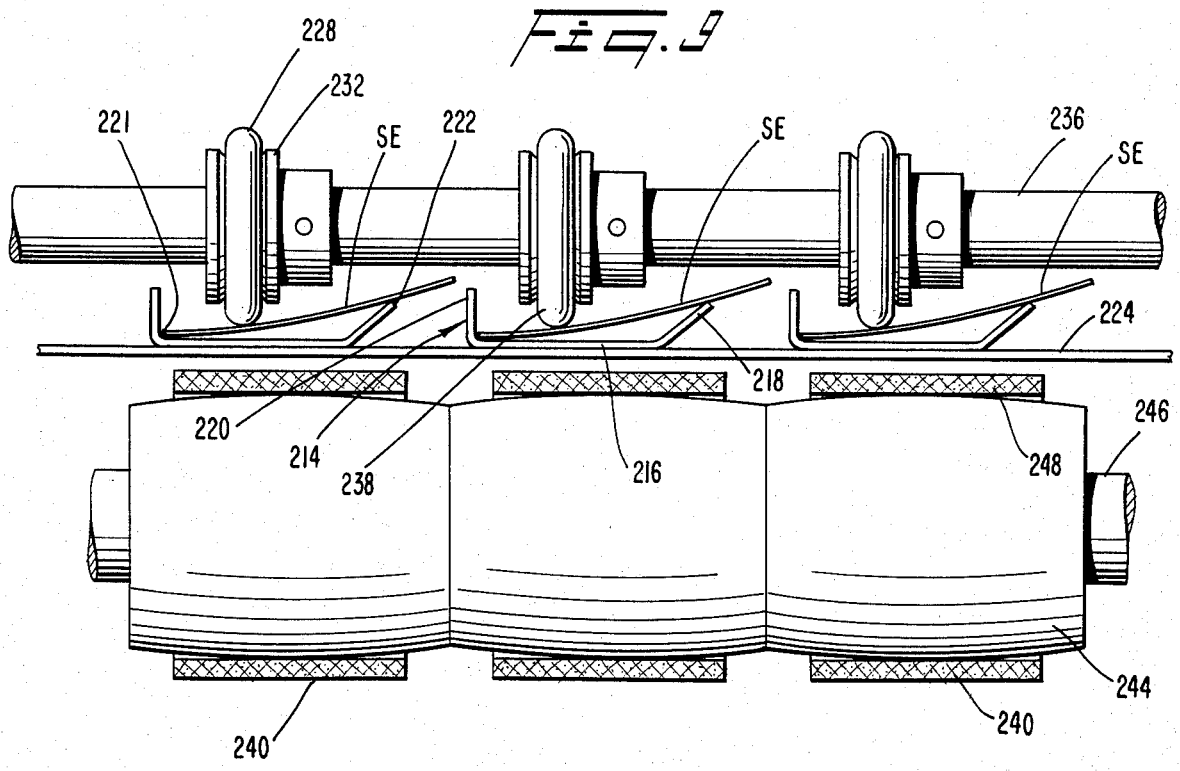
FIG. 9 is a cross-sectional view taken along line 9—9 of FIG. 8, wherein the fan-out section is viewed from a downstream end thereof.

The fan-out section 22 comprises a plurality of guides in the form of channel members 214 (FIGS. 4, 9) along which the segments SE travel. The channel members 214 each include a horizontal floor portion 216 and first and second upstanding legs 218, 220. The first leg 218 is inclined relative to horizontal and includes an upper edge 222. The second leg 220 is generally vertically disposed and defines a guide or retainer wall against which a lower edge of a segment SE bears. The first leg 218 supports the paper segments in an inclined fashion above the floor 216. This is preferably achieved by making the distance from the bottom edge 221 of the guide leg 220 to the top edge 222 of the inclined leg 218 shorter than the width of each segment, so that the segment projects beyond the upper edge 222 as it lays on the channel member 214 and is inclined relative to horizontal. Of course, other shapes of the channel would suffice to achieve an inclination of the segments.

Each channel member 214 is adjustably mounted on a planar table 224 by means of two bolts 226 which pass through holes in the floors of the channel members and are received in slots 228 formed in the able 224. Nuts (not shown) are connected to the lower ends of the bolts 226 to enable the channel members 214 to be clamped in various positions of adjustment. Thus, the channel members 224 can be arranged in alignment with the cutter rolls 204, 206 and directed in various directions. In particular, the channel members can be disposed in diverging relationship away from the cutter section 20 to fan-out the segments, i.e., increase the lateral spacing between the cut segments SE as the latter travel toward the collection section 24. This assures that laterally adjacent segments do not become laterally overlapped in a manner which would interfere with proper entry into the collection section.

Figure 8:
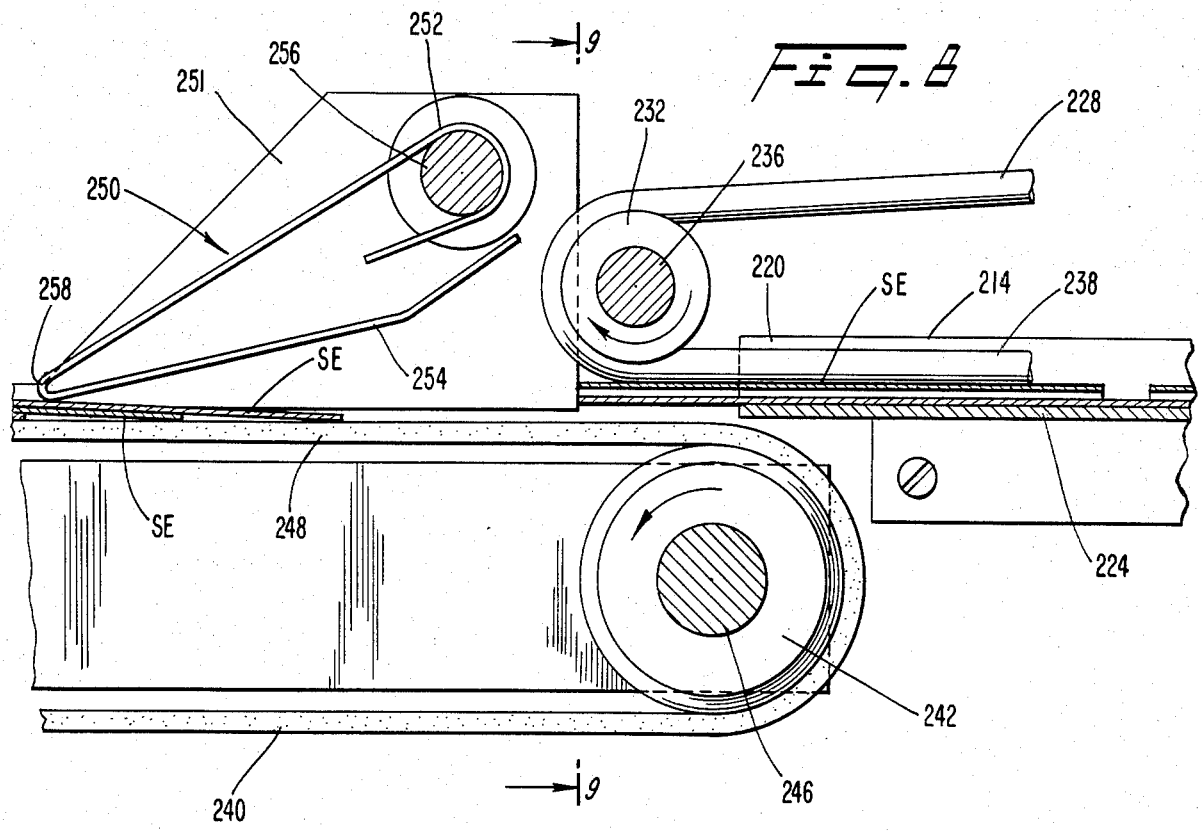
FIG. 8 is a longitudinal sectional view taken along line 8—8 of FIG. 2, depicting the junction of the fan-out section and a collecting section wherein the segments are collected.

In order to propel the cut segments SE along the channel members, there are provided a series of resilient drive bands 228 preferably formed of polyurethane. Each of those bands 228 is wrapped around a pair of upstream and downstream sheaves 230, 232. The upstream sheaves 230 are fixedly mounted on a drive shaft 234 which is positively driven. The downstream sheaves 232 are fixedly secured on a free-wheeling shaft 236. Rotation of the upstream sheaves 230 is directed such that the lower flights 238 (FIG. 8) of the bands travel from the cutting section 20 toward the collecting section 24.

The sheaves 230, 232 are located such that the plane of each band 228 intersects an imaginary line extending from the lower edge 221 of the upstanding leg 220 and the upper edge 222 of the inclined leg 218 of the associated channel member 214. Furthermore, the bands 228 are disposed at such height relative to the channel members 214 that the lower flight 238 of the band extends below such imaginary line. As discussed earlier, the segments SE lie on the channel members 214 such that each segment rests upon (i) the floor 216 with one edge in engagement with the lower edge 221 of the leg 220, and (ii) the upper edge 222 of the inclined flange. Thus, each segment is supported along two laterally-spaced lines of support.

It will be appreciated that each segment SE is engaged by the lower flight 238 of an associated drive band 228 intermediate those lines of support and is deflected downwardly. A high degree of frictional drive engagement is thus established between the drive bands 228 and the segments to propel the segments.

Since the segments SE are supported along two laterally-spaced lines of support while being engaged by the drive bands, only minimal frictional resistance to segment travel is created. Thus, it is assured that a positive conveyance of the segments is established absent any appreciable slippage between the segments and the bands. This is important in insuring that the machine can be operated at high-speed and high-throughput rates.

The downstream end of the lower flight 218 of each band 228 lies closer to the second leg 220 of each channel than does the upstream end, i.e., the lower flight is angled toward the second leg 220 in the downstream direction. Thus, as the segments are propelled in an aft-direction, they are simultaneously passed against the second leg 220.

Collection Section

As the segments SE are discharged from the downstream ends of the channel members 214, they enter the collection section 24 which includes a plurality of conveyor belts 240 aligned with respective ones of the channel members 214. Each conveyor belt 240 is wrapped around a pair of upstream and downstream rolls 242, 244 (see FIGS. 2,9). The upstream rolls 242 are affixed to a drive shaft 246 which is rotated such that the upper flight 248 of each conveyor belt 240 travels away from the discharge end of the associated channel member 214.

The upper flight 248 of each conveyor belt 240 is disposed at a lower elevation than the discharge end of the associated channel member 214, so that each segment SE leaving the latter becomes airborne at a high rate of speed, before landing upon the conveyor belt 240. Accordingly, there are provided a plurality of deflector members 250 above the respective conveyor belts 240 and in alignment with the channel members 214. Each deflector member 250 comprises a bent strip of light-weight material, preferably aluminum, which forms a mounting portion 252 and a deflecting portion 254. The mounting portions 252 are freely looped around a support rod 256 which extends across and above the conveyor belts 240. Divider plates 251 are affixed to the rod 256 to separate the conveyor belts 240.

The deflecting members 250 are thus freely pivotal and have ends 258 thereof supported by the conveyor belts 240. The deflecting portion 254 of each member 250 faces the discharge end of the associated channel member and is inclined downstream and downwardly such that a segment SE which is propelled from the channel member 214 strikes the deflecting portion 254. Consequently, the momentum of the segment is dissipated and the latter drops onto the upper flight 248 of the associated conveyor belt 240. The linear speed of the conveyor belts 240 is less than the linear speed of the drive bands 228, whereby the segments become longitudinally overlapped or shingled as they accumulate upon the conveyor belts 240. This makes it relatively easy to pick-up the segments, or to allow the segments to form stacks upon reaching a terminal end 245 of the collection section.

Drive Train and Clutch

The drive shafts 302, 64, 200, 202, and 234 are power driven by a variable speed electric D.C. motor 280 (FIG. 1). A splined drive belt 282 extends from the motor output 281 and around a plurality of grooved pulleys 283, 284, 286 affixed respectively to the drive shafts 202, 200 and 234 (associated with the lower cutter rolls 206, the upper cutter rolls 204, and the drive bands 228, respectively). A drive band 288 drivingly interconnects the shaft 202 with pulleys 290, 292 which are operably connected to the drive shafts 36, 64,respectively (associated with the feed roll 28 and the conveyor belt 52, respectively).

It will be appreciated that by adjusting the output speed of the motor 280, the speeds of the various drive shafts are adjusted in proper proportion.

The drive shaft 246 of the collection conveyor belts 240 is driven by a separate electric motor (not shown) so that the speed of the belts 240 can be regulated independently of the other drive shafts.

During operation, it may occur that an operator wishes to interrupt the in-feed of sheets S. This can be accomplished by means of a clutch mechanism 300 without shutting down the motor 280 and the remaining drive shafts.

Figure 2:
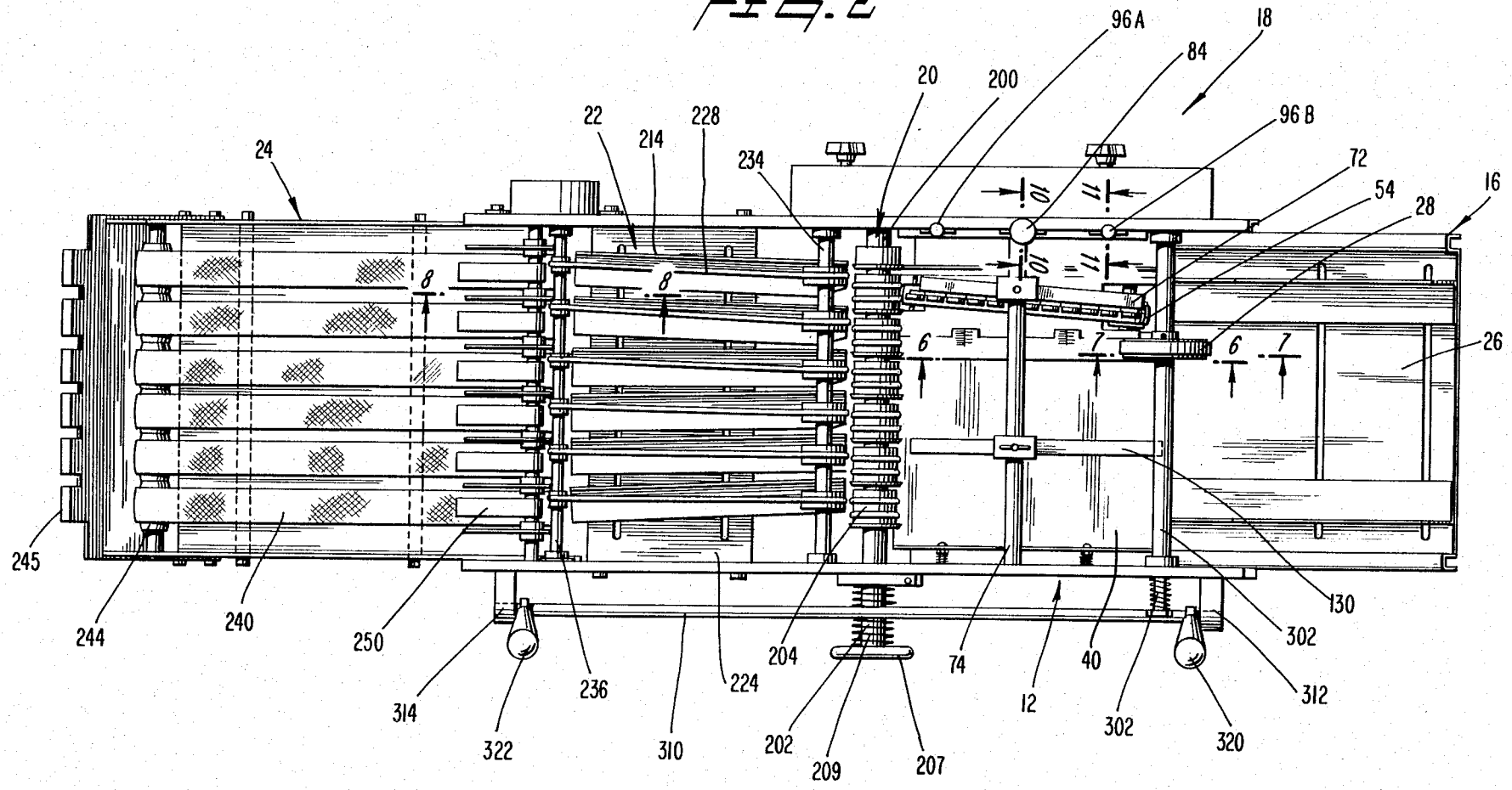
FIG. 2 is a plan view of the machine depicted in FIG. 1.

In this regard, the afore-mentioned drive shaft 36 for the feed roll 28 is coaxially disposed upon a center shaft 302 (FIG. 13), the latter being arranged for longitudinally slidable movement relative to the former. One end of the center shaft 302 extends beyond the drive shaft 36 and has the pulley 290 affixed thereto. The other end of the center shaft 302 extends beyond the drive shaft 36 and abuts against a cam bar 310 (FIGS. 2, 13). The cam bar 310 is rotatably mounted in a pair of journal blocks 312, 314 affixed to the frame 12. A cap 316 is affixed to the end of the center shaft 302 and is received within a slot formed within the cam bar 310 (FIG. 2). A pair of manual levers 320, 322 are affixed to the cam bar 310 for rotating the latter. In so doing, a cam surface 326 of the cam bar (FIG. 13) engages the collar 316 and longitudinally displaces the center shaft 302. This results in a clutch pad 321 of the pulley 290 being shifted out of frictional driving engagement with a clutch disc 330 affixed to the hollow drive shaft 36. This causes the driving transmission to the feed roll 28 to be interrupted. When the cam bar 310 is thereafter rotated to mate the slot with cap 316, a coil compression spring 332, acting between the frame 12 and the cap 316, returns the center shaft 302 to its drive-transmission position wherein the pulley clutch 290 drivingly engages the clutch disc 330 and drives the latter.

Conveniently, the cam bar 310 is elongated in the fore-aft direction, and the levers 320, 322 are disposed at the ends of the bar 310, whereby rotation of the cam bar 310, can be conveniently performed by the operator while located at either end of the machine, i.e., while the operator views either the feeding action or the resultant condition of the cut segments SE in the collection section 24.

Operation

IN OPERATION, a stack of paper sheets S to be slit is placed on the chute 26 of the in-feed section 16. When the feed roll 28 is rotated, the sheets S are fed one-at-a-time between the feed roll 28 and the pressure roll 30 (FIG. 7). The leading edge of the fed sheet is delivered to the conveyor belt 54 and is conveyed in a fore-aft direction by such conveyor belt simultaneously toward the cutting section 20 and the locator surface 48. The latter has been previously set in a desired position to properly align the sheets with the cutting rolls 204, 206. After one or more of the sheets has been cut, the cut segments can be inspected to determine if the sheets have been properly located.

If adjustment of the locator surface 48 is required, this may be achieved by rotating any or all of the threaded bolts 84, 96A, 96B (FIGS. 6, 10, 11). If the bolt 84 is actuated, both of the wedge slides 92A, 92B will be moved simultaneously, thereby causing the fore and aft ends of the locator surface 48 to be moved simultaneously inwardly our outwardly in a direction laterally of the fore-aft direction. If it is determined that relative adjustment between the fore and aft ends of the locator surface is required, this can be accomplished by actuating an appropriate one of the secondary bolts 96A, 96B to independently move the associated wedge slide 92A or 92B.

The conveyor belt 52 feeds the sheets into the nip between the cutter rolls 204, 206, whereupon the sheets are severed along a plurality of fore-aft extending cut lines.

If more than one sheet enters the nip of the cutter rolls, the bottom edges 210 can be displaced relative to the upper edges 208 against the bias of the spring 209, thereby preventing a jam-up of the machine.

The cut segments SE are delivered to the guide channels 214 (FIGS. 4, 9) and are each supported along laterally spaced support lines defined by (i) the upper edge 222 of the leg 218 and (ii) the floor 216 where it intersects the leg 220. The lower flights of the drive bands 228 contact the respective segments intermediate the lines of support and deflect the segment downwardly to maximize the frictional driving engagement therebetween. Thus, the cut segments are conveyed toward the collecting section 24 while being pushed against the stop legs 220, whereupon the segments are delivered onto the conveyor belts 240. As the segments are discharged from the guide channels 214, they engage the deflector members 250 and drop downwardly onto the preceding segment in overlapping relationship therewith.

If it is desired to interrupt the in-feed roll 28 for any reason, this can be achieved by suitable rotation of either of the actuating levers 320, 322 (FIGS. 2, 13). Accordingly, the cam bar 310 is rotated to cause displacement of the inner shaft 302 in a direction causing mutual separation between the clutch discs 290, 330. Thus, even though the clutch disc 290 continues to be rotated by the endless band 288, the drive transmission to the feed roll 28 is interrupted.

It will be appreciated that the present invention facilitates the high-speed cutting of paper sheets. That is, the fan-out section 22 effects a rapid advancement and divergence of the cut segments by means of a highly effective, yet relatively uncomplicated and simplified structure. That is, the provision of guide channels 214 and endless drive bands 228 assure a slip-proof friction driving of the segments.

The aligning section 18 enables the locator surface 48 to be quickly and precisely adjusted to minimize the shutdown period required during re-alignment of the sheets relative to the cutting mechanism.

Jamming of the machine due to the simultaneous entry of too many sheets into the cutting nip is prevented by the ability of the lower cutters to be displaced axially relative to the upper cutters.

The clutching mechanism for the feed roll 28 is convenient because it can be actuated by an operator standing at the front or rear ends of the machine, since there are two actuating levers for the clutch. This clutching is achieved, even while the remaining driven members are continued to be driven.

Although the invention has been described in connection with a preferred embodiment thereof, it will be appreciated by those skilled in the art that additions, modifications, substitutions, and deletions not specifically described, may be made without departing from the spirit and scope of the invention as defined in the appended claims.

What is claimed is:

1. A mechanism for handling paper comprising a plurality of fore-aft extending guide members each including side walls so as to form a channel and means for supporting a segment of paper along at least two laterally spaced lines of support, a first of said lines of support being a sidewall and another being located within the channel and vertically offset from said first line of support, and a plurality of movable driving means disposed above respective ones of said guide members and arranged to bear against said paper segments intermediate all lines of support for deflecting said segments downwardly and effecting a frictional driving engagement therewith in said fore-aft direction.

2. A mechanism according to claim 1 wherein said driving means each comprises an endless conveying band having a lower flight arranged for contacting the segments.

3. A mechanism according to claim 2 wherein the direction of movement of each conveying band is at an angle to the direction of travel of said segments.

4. A mechanism for handling paper comprising a plurality of fore-aft extending guide members each including side walls so as to form a channel and means for supporting a segment of paper along laterally spaced lines of support, a first of said lines of support being a sidewall and another being located within the channel and vertically offset from said first line of support, and a plurality of movable driving means disposed above respective ones of said guide members and arranged to bear against said paper segments intermediate of lines of support for deflecting said segments downwardly and effecting a frictional driving engagement therewith in said fore-aft direction, and wherein a side wall of each of said guide members provides a means for restraining an adjacent lower edge of each segment against lateral displacement.

5. A mechanism according to claim 4, wherein said conveying bands angled relative to said driving means comprising restraining means to urge the segments thereagainst as the segments are being conveyed.

6. A mechanism according to claim 1 wherein said guide members each include a bottom member joined to said sidewalls and said another line of support is at the junction of said bottom member and one of the sidewalls.

7. A mechanism according to claim 6 wherein said driving means deflect said paper segments downwardly a distance less than the height of said one of the sidewalls.

8. A mechanism according to claim 6 wherein said one of the sidewalls is substantially normal to said bottom member and said sidewall being a line of support is at an acute angle with respect to said bottom member.

* * * * *